US005724049A

United States Patent [19]

Park et al.

[11] Patent Number: 5,724,049

[45] Date of Patent: Mar. 3, 1998

[54] END LAUNCHED MICROSTRIP OR STRIPLINE TO WAVEGUIDE TRANSITION WITH CAVITY BACKED SLOT FED BY OFFSET MICROSTRIP LINE USABLE IN A MISSILE

[75] Inventors: Pyong K. Park, Agoura Hills, Calif.; Eric L. Holzman, Medford, N.J.

[73] Assignee: Hughes Electronics, Los Angeles, Calif.

[21] Appl. No.: 247,363

[22] Filed: May 23, 1994

[51] Int. Cl.[6] ..... H01Q 1/28; H01P 5/107

[52] U.S. Cl. ..... 343/705; 343/767; 343/772; 343/789; 333/26; 333/33

[58] Field of Search ..... 333/26, 33; 343/708, 343/705, 767, 770, 772, 789; 244/3.14, 3.19

[56] References Cited

U.S. PATENT DOCUMENTS

| | | | |
|---|---|---|---|
| 2,877,429 | 3/1959 | Sommers et al. | 333/24 R |
| 2,885,676 | 5/1959 | Baldwin | 343/767 |
| 3,710,338 | 1/1973 | Munson | 343/708 |
| 5,337,065 | 8/1994 | Bonnet et al. | 343/770 X |
| 5,414,394 | 5/1995 | Gamand et al. | 333/26 |

FOREIGN PATENT DOCUMENTS

| | | | |
|---|---|---|---|
| 4108942 | 9/1992 | Germany | 333/26 |
| 51604 | 3/1984 | Japan | 333/26 |
| 113502 | 6/1985 | Japan | 343/767 |
| 79104 | 4/1991 | Japan | 333/33 |
| 4109702 | 4/1992 | Japan | 333/26 |
| 843042 | 6/1991 | U.S.S.R. | 333/21 A |

OTHER PUBLICATIONS

Breithaupt, Robert W., "Conductance Data for Offset Series Slots in Stripline"; *IEEE Transaction on Microwave Theory & Techniques;* vol. MTT-16, No. 11; Nov. 1968; pp. 969, 970.

*Primary Examiner*—Benny T. Lee

*Attorney, Agent, or Firm*—Charles D. Brown; Wanda K. Denson-Low

[57] ABSTRACT

A low profile, compact microstrip-to-waveguide transition which utilizes electromagnetic coupling instead of direct coupling. The end of the waveguide is terminated in a cavity backed slot defined in a groundplane formed on a dielectric substrate. The slot is excited by a microstrip line defined on the opposite side of the substrate, offset from the slot centerline. A cavity covers the substrate on the microstrip side, and is sized so that no cavity modes resonate in the frequency band of operation. The transition is matched by appropriate selection of the length of the slot and the length and position of the microstrip.

12 Claims, 3 Drawing Sheets

FIG. 1.
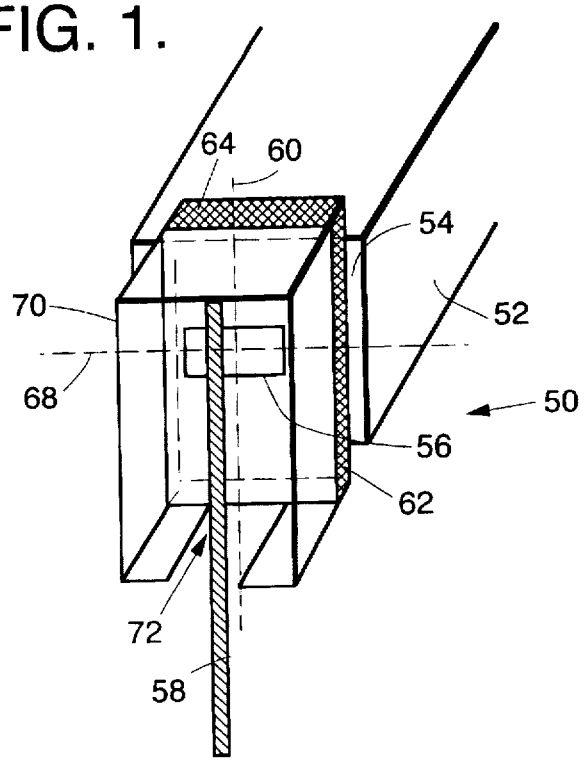
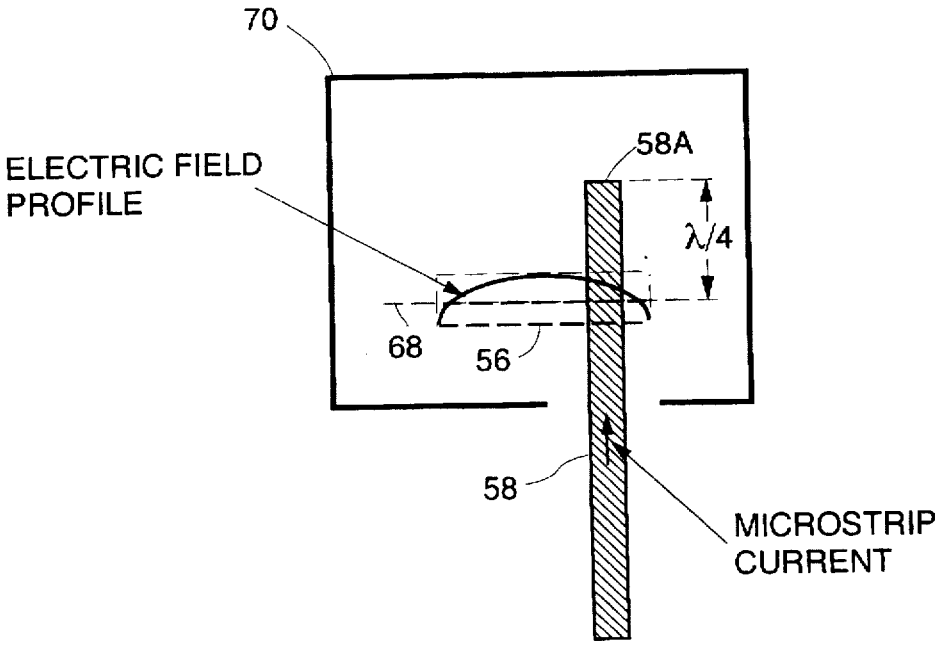
FIG. 2.

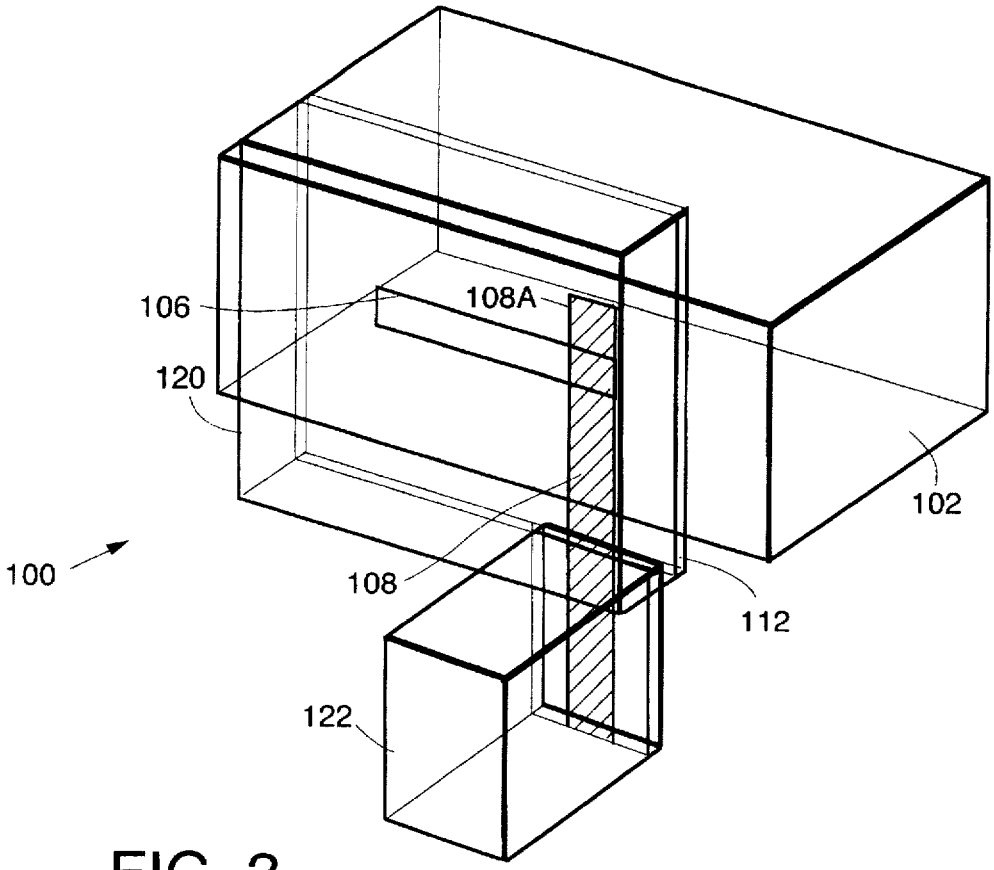
FIG. 3.
FIG. 4.
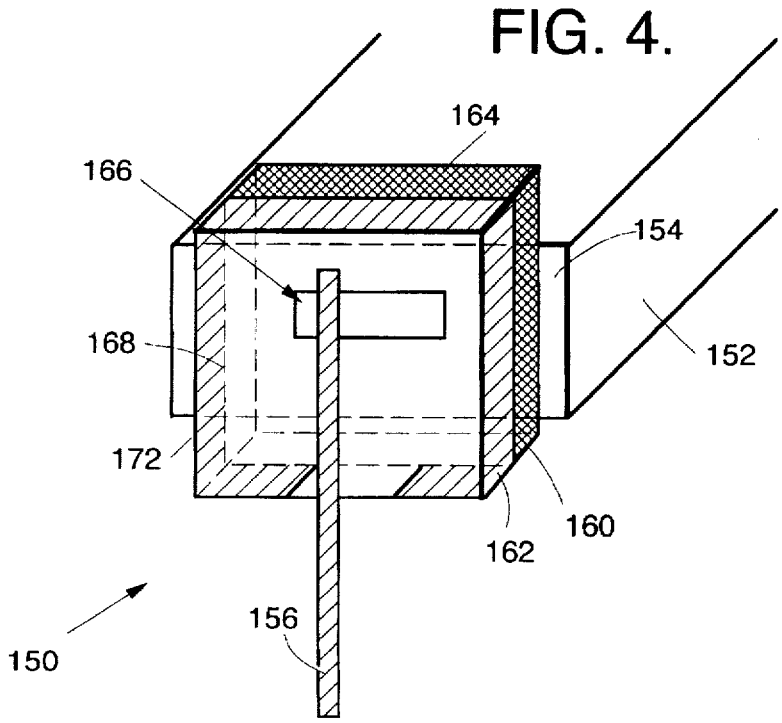

END LAUNCHED MICROSTRIP OR STRIPLINE TO WAVEGUIDE TRANSITION WITH CAVITY BACKED SLOT FED BY OFFSET MICROSTRIP LINE USABLE IN A MISSILE

This invention was made with Government support under Contract No. DASG60-90-C-0166 awarded by the Department of the Army. The Government has certain rights in this invention.

TECHNICAL FIELD

This invention relates to transitions between a waveguide and a microstrip line or stripline.

RELATED APPLICATION

This application is related to commonly assigned application Ser. No. 08/247,732, filed May 23, 1994, "END LAUNCHED MICROSTRIP OR STRIPLINE TO WAVEGUIDE TRANSITION WITH CAVITY BACKED SLOT FED BY T-SHAPED MICROSTRIP LINE OR STRIPLINE USABLE WITH A MISSILE," by P. K. Park and E. Holzman.

BACKGROUND OF THE INVENTION

Microstrip-to-waveguide transitions are needed often in microwave applications, e.g., radar seekers. Modern millimeter wave radars and phased arrays have a need for a compact, easy to fabricate high performance transition. Usually, the antenna and its feed are built from rectangular waveguide, and the transmitter and receiver circuitry employ planar transmission lines such as microstrip line or stripline. The microstrip-to-waveguide transition plays a critical role in that it must smoothly (i.e., with minimal RF energy loss) transfer the energy between the transmitter or receiver and the antenna. Traditional microstrip-to-waveguide transitions are bulky, and they require that the microstrip line directly couple with the waveguide by penetrating its broadwall; such transitions are not very compatible with the thin planar structures of state-of-the-art radars.

The conventional microstrip-to-waveguide transition employs a microstrip probe, and is difficult to fabricate because the microstrip probe must be inserted into the middle of the waveguide. A hole must be cut in the waveguide wall for the probe to penetrate. A backshort must be positioned precisely behind the probe, about one-quarter wavelength. Fabricating the transition with the backshort placed accurately is difficult. Furthermore, the transition does not provide a hermetic seal, and it is difficult to separate the waveguide structure which leads to the antenna and the microstrip. A separate set of flanges must be built into the antenna to allow separation of the antenna and transmitter/receiver.

Another type of transition is the end launched microstrip loop transition. This transition is difficult to fabricate because the end of the loop must be attached physically to the waveguide broadwall. It is difficult to position the substrate precisely and to hold it in place securely. There is no hermetic seal, and also to separate the waveguide and microstrip line requires breaking the microstrip line for this transition. Further, the substrate is aligned parallel to the waveguide axis instead of perpendicular; such a configuration does not lend itself well to constructing compact layered phased arrays.

SUMMARY OF THE INVENTION

A low profile, compact microstrip to waveguide transition, employing electromagnetic coupling is described.

The transition includes a termination for terminating an end of said waveguide, comprising a dielectric substrate having opposed first and second surfaces, wherein a layer of conductive material is defined on a first surface thereof facing the interior of the waveguide. The conductive layer has an open slot defined therein characterized by a slot centerline. A microstrip conductor is defined on the second opposed surface disposed transversely relative to the slot and offset from its centerline. In an exemplary embodiment, the conductor terminates in an open-circuited end located one-quarter wavelength past the slot centerline. A conductive cavity is defined behind the second substrate side. Dimensions of the cavity are such that no cavity modes resonate in the frequency band of operation of the transition.

Dimensions and placement of the slot and placement of the microstrip conductor are preferably selected to match the waveguide and microstrip transmission line characteristic impedances.

BRIEF DESCRIPTION OF THE DRAWING

These and other features and advantages of the present invention will become more apparent from the following detailed description of an exemplary embodiment thereof, as illustrated in the accompanying drawing, in which:

FIG. 1 is a simplified isometric view of an offset microstrip-to-waveguide transition in accordance with this invention.

FIG. 2 is a schematic diagram illustrating the sinusoidal electric field profile excited by the microstrip line of the transition.

FIG. 3 is a simplified isometric view of an exemplary embodiment of the transition.

FIG. 4 shows an exemplary waveguide to stripline transition in accordance with the invention.

DETAILED DESCRIPTION OF THE PREFERRED EMBODIMENT

Figure 5:
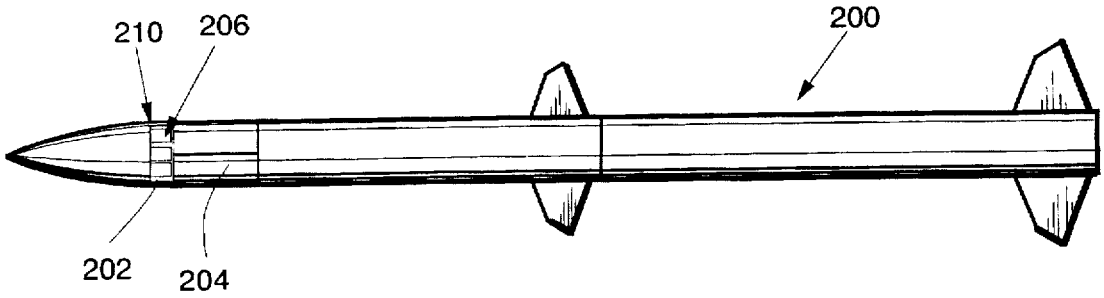
FIG. 5 shows a simplified illustration of an air-to-air missile having an RF processor including a transition in accordance with the invention.

This invention introduces a low profile, compact microstrip-to-waveguide transition which utilizes electromagnetic coupling instead of direct coupling. An exemplary embodiment of a transition 50 for transitioning between a rectangular waveguide 52 and a microstrip line 58 is shown in FIG. 1. The end 54 of the waveguide 52 is terminated in a cavity backed slot 56 which is excited by a microstrip line 58 offset from the slot centerline 60. The slot 56 and microstrip line 58 are etched on the opposite sides of a dielectric substrate 62, fabricated of a dielectric material such as quartz. Thus, in the conventional manner, the opposite sides of the substrate 62 are initially covered with a thin film of conductive material such as copper. Using conventional thin-film photolithographic etching techniques, the dimensions of the slot and microstrip and their positions can be fabricated precisely, easily and inexpensively. The slot 56 is defined by removing the thin copper layer 64 within the slot outline. To define the microstrip conductor 58, the thin copper layer is removed everywhere except for the material defining the microstrip conductor. Thus, the substrate 62 and line 58 define a conventional microstrip transmission line, except for the slot defined in the groundplane layer 64. A backshort placed one-quarter wavelength behind the microstrip line (required in conventional transitions) is not required in this transition.

In this embodiment, the slot 56 is centered on the end 54 of the waveguide 52, in that the longitudinal centerline or axis 68 of the slot is coincident with a center line extending parallel to the long dimension of the waveguide end, thus centering the slot along the short dimension of the waveguide; and the slot is also centered along the long dimension of the waveguide as well. This placement will depend on the type of waveguide for which the particular transition is designed. For example, the slot will be centered at the end of a circular waveguide. The microstrip line 58 is disposed transversely to the slot longitudinal centerline 68 and offset from the transverse centerline or axis 60.

In the typical application, the substrate 62 comprises a portion of a larger substrate, in turn comprising a larger microwave circuit comprising a plurality of microstrip lines defined on the substrate, and with other waveguides having their own transition in the same manner as illustrated for waveguide 52 and transition 50.

When the microstrip line 58 is excited, currents flow on the line 58 and the ground plane 64 directly below it. If a slot is cut in the ground plane in the path of the microstrip, e.g., slot 56, the microstrip current (indicated by the arrow in FIG. 2) is disturbed, and an electric field is exited in the slot 56, as shown in FIG. 2. If the end of a rectangular or circular waveguide is placed adjacent to the slot, as shown in FIG. 1, the microstrip energy will couple to the slot electric field and into the waveguide. The transition 50 exploits this energy transfer property.

The slot 56 also can couple the microstrip energy to unwanted modes such as the parallel-plate and dielectric surface wave modes; such energy would be wasted in that it does not couple to the waveguide and increases the transition energy loss. Moreover, in the event the transition is used in a larger, more complex circuit employing a plurality of similar microstrip to waveguide transitions, there can be interference between transitions.

To eliminate the coupling to these unwanted modes, a rectangular cavity 70 (see FIGS. 1 and 2) can be used to cover the transition on the side of the microstrip line 58. The cavity 70 is essentially a four sided electrically conductive enclosure, having a closed end parallel to the substrate 62 of FIG. 1. The cavity 70 includes a small opening 72 (see FIG. 1) defined about the microstrip transmission line to permit the line to exit the cavity without shorting to the cavity walls. If the opening maintains a spacing from the line equal to about three times the width of the line, typically no capacitive loading will occur. Smaller openings may require use of known measures to adjust for the effects of the capacitance. The cavity dimensions must be chosen so that no cavity modes resonate in the transition's frequency band of operation. The selection of cavity dimensions to accomplish this function is well known to those skilled in the art.

To maximize the amount of energy transferred from the microstrip line 58 to the waveguide 52, the transition 50 is matched by appropriate selection of the length of the slot and the position and length of the microstrip line 58. Typical waveguide characteristic impedances are of the order of 100 to 350 ohms depending on the waveguide height. On the other hand, the characteristic impedance of the microstrip line is usually 50 ohms for most applications. One way to match these impedances is to use quarter wavelength impedance transformers on either the microstrip side or the waveguide side or both. These transitions add length and complexity to the transition. This invention eliminates the need for these transformers by taking advantage of the natural transforming characteristics of the slot. FIG. 2 shows the electric field profile of the slot when its length is resonant. The slot length is resonant when the input impedance seen at the slot centerline 68 is pure real valued. This resonant behavior is well understood: the voltage profile along the slot is sinusoidal, while the current remains constant. Thus, the impedance seen by a microstrip line placed at the center of the slot is maximum, while the impedance decreases as the microstrip is offset toward the slot edge; if the microstrip is moved all the way to the edge, it sees a zero ohm impedance. Thus, as the microstrip is offset toward the edge, it will eventually see a 50 ohm impedance. Further, by extending the open-circuited end 58A of the microstrip line 58 one-quarter wavelength (L14) past the slot centerline, as shown in FIG. 2, maximum current will excite the slot 56 and give the best match.

The transition can be constructed without the cavity 70 backing the slot, and it can still be matched to the waveguide and operate well. However, if the transition is part of a more complex assembly including a plurality of transitions, then energy from one transition can interfere with energy from another transition. If, however, such isolation is not required in a particular application, the transition can omit the cavity 70.

FIG. 3 is a simplified line drawing of an embodiment of a Ka-band waveguide-to-microstrip transition 100 in accordance with the invention. The waveguide 102 has a rectangular cross-sectional configuration which is 140 by 280 mils. The quartz substrate 112 is 200 by 186 mils, with a thickness of 10 mils. The slot 106 is centered within the end of the waveguide, and is 124 mils in length by 20 mils in width. The microstrip conductor 108 is 21.4 mils in width, and is offset 59 mils from the center of the slot, with the open circuit end 108A extending 52 mils above the slot centerline. The cavity 120 has a depth of 50 mils. A channel 122 is provided for the microstrip line, and is 79 mils high, by 135 mils deep, and 65 mils wide in this exemplary embodiment.

FIG. 4 shows a waveguide to stripline transition 150 for transitioning between a rectangular waveguide 152 and a stripline, employing a cavity (172) backed slot 166 in accordance with the invention. This transition is similar to the microstrip to waveguide transition 50 of FIG. 1, except that the stripline conductor 156 is sandwiched between two layers of dielectric. As in the transition 50, a dielectric substrate 160 is disposed at the end 154 of the waveguide 152. The substrate surface facing the interior of the waveguide is covered with a conductive layer 164, in which the slot 166 is defined by selectively removing the conductive layer within the slot outlines. On the opposite surface of the substrate 160, the stripline conductor 156 is defined by selectively removing the conductive layer covering the surface 168. In contrast to the waveguide to microstrip transition 50, the transition 150 includes a layer of dielectric 162 adjacent the conductor surface 168 of the first substrate 160, so that conductor surface 168 is sandwiched between substrate 160 and dielectric layer 162.

Figure 6:
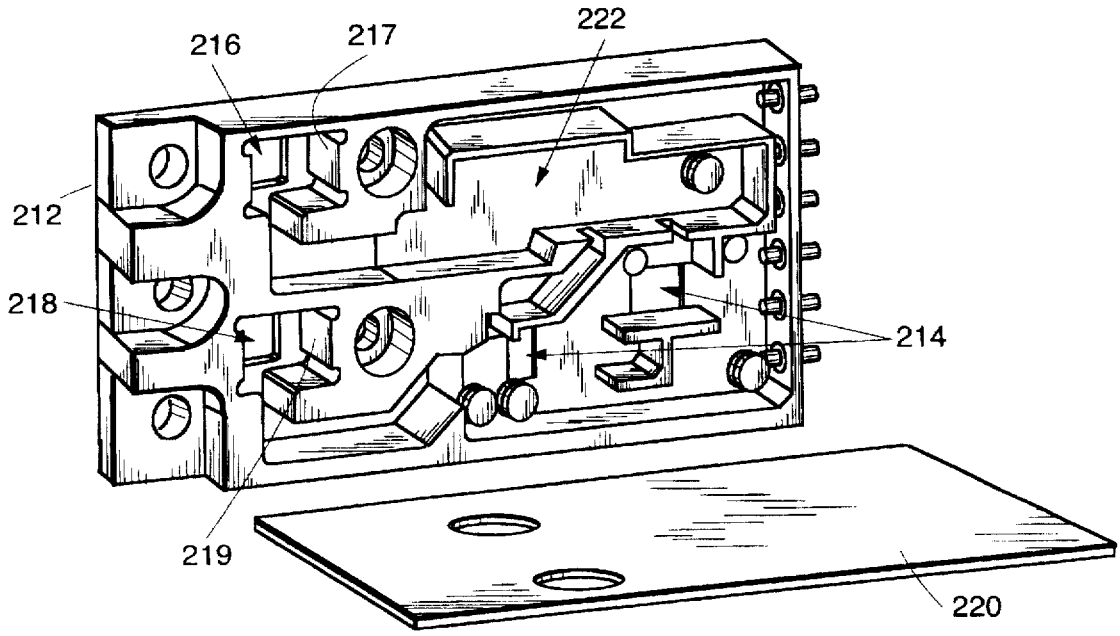
FIG. 6 shows a simplified RF processor of the missile of FIG. 5.

One particular application to which the invention can be put to use is in the RF processor of a missile, e.g., an air-to-air missile having a seeker head to guide the missile to a target. One such missile 200 is shown in simplified form in FIG. 5. The missile includes an antenna section 202, a transmitter section 204, a receiver module 210 including an RF processor, and a seeker/servo section 206. The receiver module is shown in further detail in FIG. 6, and includes a module chassis 212 which supports several active devices including low noise amplifiers 214. The module includes an LO input port 216 and a receive signal port 218. The LO and receive signals are delivered to the respective ports via waveguides (not shown) connected at the back side of the housing. A quartz substrate (not shown) carries microstrip or stripline circuitry (not shown in FIG. 6) used to define the waveguide to microstrip transition or waveguide to stripline transition in accordance with the invention. The cavity backing the transition is defined by sides of the chassis channel 217 and 219 and the module cover 220. In this example, the microstrip or stripline conductor leading away from the LO port 216 is connected to a mixer/control circuit located in area 222 of the chassis, and the microstrip or stripline conductor leading away from the receive signal port 218 is connected to the low noise amplifiers 214. The receiver module 210 is sealed hermetically at the two input ports 216 and 218 by the quartz substrate covering the port openings and being sealed to the chassis around the perimeter of the openings. The particulars of the waveguide to microstrip-line or stripline transitions are as shown in FIG. 1 and FIG. 4.

Current trends in RF seeker design emphasize the reduction of cost and volume while achieving high performance. For millimeter wave radars and phased radars, the packaging of the seeker is a significant problem. In some cases, although the components can be designed and built, they all cannot be placed physically within the seeker envelope. To integrate the antenna with the transmitter/receiver circuitry is a difficult task with conventional, bulky microstrip-to-waveguide transitions. A typical active phased array can easily require hundreds of these transitions. This invention provides tremendous cost savings and volume reduction and can make presently unrealizeable radar designs feasible.

This invention provides a low profile end launched microstrip-to-waveguide transition which has the following advantages compared to existing microstrip-to-waveguide transitions:

1. A microstrip line does not have to penetrate the waveguide.

2. A backshort does not have to be placed one-quarter wavelength behind the microstrip line.

3. The transition is compact and easy to fabricate from a single piece of dielectric substrate.

4. The transition is compatible with the planar structure of standard transmitter and receiver modules used in phased arrays.

5. Often, to physically separate the antenna and transmitter or receiver assemblies is necessary for testing of the components. Performing this separation with conventional transitions usually requires that one break the microstrip line. This transition provides a natural flat surface (the substrate 58 with the slot in FIG. 1) to easily separate the assemblies without breaking any circuitry.

6. The transition substrate automatically creates a hermetic seal for the transmitter and receiver assemblies, typically located on a microstrip or stripline circuit board. In particular, the receiver typically has delicate wire bonding and active semiconductor elements which need the protective hermetic seal against corrosion.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A low profile, compact stripline transmission line to waveguide transition, employing electromagnetic coupling, comprising:

a waveguide having a first end and characterized by a waveguide characteristic impedance;

terminating means for terminating said first end of said waveguide, said terminating means comprising a dielectric substrate having opposed first and second surfaces, wherein a layer of conductive material is defined on said first surface thereof facing an interior region of said waveguide, said conductive layer having an open slot defined therein characterized by a slot center, said slot being centered on said first end of said waveguide, a transmission line conductor defined on said second opposed surface disposed transversely relative to an elongated extent of said slot and offset from said slot center by an offset distance, a length of said elongated extent is such that said slot is resonant over a frequency range of operation of said transition, said elongated extent smaller than a corresponding extent of said waveguide, and a dielectric layer disposed adjacent said conductor such that said conductor is sandwiched between said dielectric layer and said substrate, and said offset distance is such that said transition performs impedance matching between said waveguide characteristic impedance and a characteristic impedance of said stripline transmission line; and means for defining a conductive cavity adjacent said second surface of said substrate to cover said dielectric layer and to prevent coupling to unwanted parallel-plate and dielectric surface wave modes, said defining means including an end conductive surface and cavity side enclosure surface means for defining sidewalls enclosing sides of said cavity, said conductive cavity enclosing said conductor at a region adjacent said second surface, and wherein dimensions of said cavity are such that no cavity modes resonate in a frequency band of operation of said transition.

2. The transition of claim 1 wherein said waveguide is a rectangular waveguide, and said means for defining a conductive cavity defines a rectangular cavity.

3. The transition of claim 1 wherein said conductor terminates in an open-circuited end located one-quarter wavelength past a longitudinal slot center axis of said slot to maximize current exciting said slot and improve said impedance matching.

4. A low profile, compact microstrip transmission line to waveguide transition, employing electromagnetic coupling, comprising:

a waveguide having a first end and characterized by a waveguide characteristic impedance;

terminating means for terminating said first end of said waveguide, said terminating means comprising a dielectric substrate having opposed first and second surfaces, wherein a layer of conductive material is defined on said first surface thereof facing an interior region of said waveguide, said conductive layer having an open elongated slot defined therein, said slot being centered on said first end of said waveguide, and a microstrip conductor defined on said second opposed surface disposed transversely relative to an elongated extent of said slot and offset from a transverse slot center axis by an offset distance, a length of said elongated extent is such that said slot is resonant over a frequency range of operation of said transition, said elongated extent smaller than a corresponding extent of said waveguide, and said offset distance is such that said transition performs impedance matching between said waveguide characteristic impedance and a characteristic impedance of said microstrip transmission line; and means for defining a conductive cavity adjacent said second surface of said substrate to cover said second surface and to prevent coupling to unwanted parallel-plate and dielectric surface wave modes, said defining means including an end conductive surface and cavity side enclosure surface means for defining sidewalls enclosing sides of said cavity, said conductive cavity enclosing said microstrip conductor at a region adjacent said second surface, and wherein dimensions of said cavity are such that no cavity modes resonate in a frequency band of operation of said transition.

5. The transition of claim 4 wherein said waveguide is a rectangular waveguide, and said means for defining a conductive cavity defines a rectangular cavity.

6. The transition of claim 4 wherein said microstrip conductor terminates in an open-circuited end located one-quarter wavelength past a longitudinal slot center axis of said slot to maximize current exciting said slot and improve said impedance matching.

7. The transition of claim 4 wherein said waveguide is characterized by a waveguide characteristic impedance; said microstrip, dielectric substrate and groundplane define a microstrip transmission line characterized by a microstrip characteristic impedance; and wherein said microstrip characteristic impedance matches said waveguide characteristic impedance.

8. An airborne missile, comprising a missile body, a waveguide disposed in said body and having a first end and characterized by a waveguide characteristic impedance, an RF processor section disposed within said body, said processor section including a microstrip transmission line circuit, a port for coupling to said waveguide, and a microstrip transmission line to waveguide transition disposed at said port, said transition comprising terminating means for terminating said first end of said waveguide located at said port, said terminating means comprising a dielectric substrate having opposed first and second surfaces, wherein a layer of conductive material defines a groundplane on said first surface thereof facing an interior region of said waveguide, said conductive layer having an open slot defined therein characterized by a slot center, said slot being centered on said first end of said waveguide, a microstrip conductor defined on said second opposed surface disposed transversely relative to an elongated extent of said slot and offset from said slot center by an offset distance, a length of said elongated extent is such that said slot is resonant over a frequency range of operation of said transition, said extent smaller than a corresponding extent of said waveguide, and said offset distance is such that said transition performs impedance matching between said waveguide characteristic impedance and a characteristic impedance of said microstrip transmission line, and means for defining an electrically conductive cavity adjacent said second surface of said substrate to cover said second surface and to prevent coupling to unwanted parallel-plate and dielectric surface wave modes, said defining means including an end conductive surface and cavity side enclosure surface means for defining sidewalls enclosing sides of said cavity, said conductive cavity enclosing said microstrip conductor at a region adjacent said second surface, and wherein dimensions of said cavity are such that no cavity modes resonate in a frequency band of operation of said transition.

9. The missile of claim 8 wherein said microstrip conductor terminates in an open-circuited end located one-quarter wavelength past a longitudinal slot center axis of said slot to maximize current exciting said slot and improve said impedance matching.

10. The missile of claim 8 wherein said waveguide is characterized by a waveguide characteristic impedance; said microstrip, dielectric substrate and groundplane define a microstrip transmission line characterized by a microstrip characteristic impedance; and wherein said microstrip characteristic impedance matches said waveguide characteristic impedance.

11. An airborne missile, comprising a missile body, an RF processor section disposed within said body, and a waveguide disposed in said body and having a first end and characterized by a waveguide characteristic impedance, said processor section including a stripline transmission line circuit, a port for coupling to said waveguide, and a stripline transmission line to waveguide transition disposed at said port, said transition comprising terminating means for terminating said first end of said waveguide located at said port, said terminating means comprising a dielectric substrate having opposed first and second surfaces, wherein a layer of conductive material defines a groundplane on said first surface thereof facing an interior region of said waveguide, said conductive layer having an open slot defined therein, said slot being centered on said first end of said waveguide, a transmission line conductor defined on said second opposed surface disposed transversely relative to an elongated extent of said slot and offset from a transverse slot center axis by an offset distance, a length of said elongated extent is such that said slot is resonant over a frequency range of operation of said transition, said extent smaller than a corresponding extent of said waveguide, and said offset distance is such that said transition performs impedance matching between said waveguide characteristic impedance and a characteristic impedance of said stripline transmission line, a dielectric layer disposed adjacent the conductor such that the conductor is sandwiched between said dielectric layer and said substrate, and means for defining an electrically conductive cavity adjacent said second surface of said substrate to cover said dielectric layer and to prevent coupling to unwanted parallel-plate and dielectric surface wave modes, said defining means including an end conductive surface and cavity side enclosure surface means for defining sidewalls enclosing sides of said cavity, said conductive cavity enclosing said conductor at a region adjacent said second surface, and wherein dimensions of said cavity are such that no cavity modes resonate in a frequency band of operation of said transition.

12. The missile of claim 11 wherein said transmission line conductor terminates in an open-circuited end located one-quarter wavelength past a longitudinal slot center axis of said slot to maximize current exciting said slot and improve said impedance matching.

* * * * *